United States Patent [19]

Deno

[11] Patent Number: 4,963,398

[45] Date of Patent: Oct. 16, 1990

[54] PROCESS FOR CONTINUOUS PRODUCTION OF SURFACE-CONSOLIDATED LUMBER

[75] Inventor: Takeo Deno, Yokohama, Japan

[73] Assignee: Sumitomo Forestry Co., Ltd., Osaka, Japan

[21] Appl. No.: 304,813

[22] Filed: Jan. 31, 1989

[30] Foreign Application Priority Data

Apr. 19, 1988 [JP] Japan ..... 63-96194

[51] Int. Cl.[5] ..... B05D 3/12

[52] U.S. Cl. ..... 427/366; 427/393.3; 427/397

[58] Field of Search ..... 427/366, 393.3, 397; 428/537.1, 511, 541

[56] References Cited

U.S. PATENT DOCUMENTS

| | | | |
|---|---|---|---|
| 2,321,937 | 6/1943 | Quinn | 427/366 X |
| 3,501,339 | 3/1970 | Gurgiolo | 427/397 X |
| 3,560,242 | 2/1971 | Urata | 427/366 X |

*Primary Examiner*—Shrive Beck
*Assistant Examiner*—Alain Bashore
*Attorney, Agent, or Firm*—Frishauf, Holtz, Goodman & Woodward

[57] ABSTRACT

A process for the continuous production of a surface-consolidated lumber, in which the surface layer of a lumber to be treated is hardened and consolidated, is provided. In this process, a lumber to be treated is coated with a thermosetting resin and is then fed between hot-pressing rolls in a plurality of pairs of hot-pressing rolls, and the lumber is continuously heat-compressed between the hot-pressing rolls and simultaneously the thermosetting resin is cured, whereby the surface of the lumber is hardened and consolidated.

23 Claims, 1 Drawing Sheet

PROCESS FOR CONTINUOUS PRODUCTION OF SURFACE-CONSOLIDATED LUMBER

BACKGROUND OF THE INVENTION

1. Field of the Invention

The present invention relates to a process for the continuous production of a surface-consolidated lumber and also to a surface-consolidated lumber produced according to this process.

2. Description of the Prior Art

Attempts have heretofore been made to improve the abrasion resistance or damage resistance of a lumber by consolidating its surface layer to increase the surface hardness. For example, there can be mentioned a method in which a lumber is impregnated with a resin [see, for example, "Mokuzai-Kogyo Handbook" (Handbook of Wood Industry), 3rd revised edition, pages 467 through 474 (1982)] and a method in which a lumber is hot-pressed on a flat-platen press.

According to the conventional resin impregnation method, however, the whole of a lumber to be treated is highly densified so that it is very difficult to consolidate only its surface layer and the whole of the lumber, that is, not only the surface layer but also the internal layers are highly densified. Accordingly, the amount of a treating agent to be used is inevitably increased, resulting in an increase in the cost, and the specific gravity of the treated lumber becomes too high.

According to the method using a flat-platen press, it is possible to consolidate only the surface layer of a lumber to be treated, but the size of a lumber to be treated is restricted by the size of the press and therefore the production cannot but be conducted batchwise and the production efficiency is inevitably low.

SUMMARY OF THE INVENTION

It is therefore a primary object of the present invention to provide a process for the continuous production of a surface-consolidated lumber, in which the surface layer of a lumber to be treated can be hardened and consolidated in a continuous manner, and a surface-consolidated lumber obtained according to the continuous production process.

Another object of the present invention is to provide a process for the continuous production of a surface-consolidated lumber, in which a high dimensional stability is imparted to a lumber, and a surface-consolidated lumber obtained according to this continuous production process.

Still another object of the present invention is to provide a process for the continuous production of a surface-consolidated lumber, in which a high fire-proofness is imparted to a lumber, and a surface-consolidated lumber obtained according to this continuous production process.

In accordance with one aspect of the present invention, said primary object is attained by providing a process for the continuous production of a surface-consolidated lumber, which comprises coating a lumber to be treated, with a thermosetting resin feeding the lumber between hot-processing rolls in a plurality of pairs of rolls, continuously heat-compressing the lumber between the hot-pressing rolls and simultaneously curing the thermosetting resin, thereby consolidating and hardening the surface layer of the lumber.

In accordance with another aspect of the present invention, said another object is attained by providing a process for the continuous production of a surface-consolidated lumber, in which a high dimensional stability is imparted to a lumber, and in accordance with still another aspect of the present invention, said still another object is attained by providing a process for the continuous production of a surface-consolidated lumber, in which a high fire-proofness is imparted to a lumber.

In the process for the continuous production of a surface-consolidated lumber according to said first aspect of the present invention, the surface layer of a lumber to be treated can be continuously consolidated and the surface of the lumber can be hardened by the thermosetting resin.

According to said another aspect of the present invention, a lumber to be treated can be continuously consolidated and simultaneously, the elongation of the lumber can be controlled by a thermosetting dimensional stabilizer.

According to said still another aspect of the present invention, a lumber to be treated can be continuously consolidated and simultaneously, the fire-proofness can be improved by a thermosetting fire-proofing agent.

DETAILED DESCRIPTION OF THE INVENTION

Figure 1:
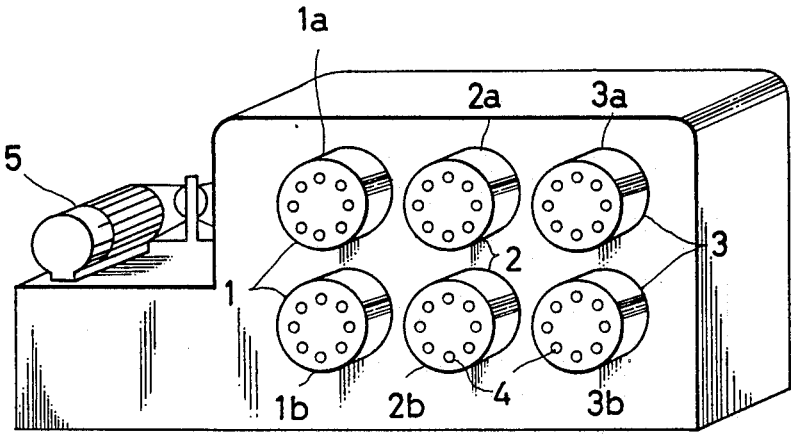
FIG. 1 is a perspective view illustrating an outline of pairs of heating rolls in a continuous production apparatus suitable for use in carrying out the process of the present invention.

To begin with, an apparatus for the continuous production of a surface-consolidated lumber, which is used in carrying out the present invention, will be described.

For example, a continuous production apparatus shown in FIG. 1 can be used. The continuous production apparatus shown in FIG. 1 is commonly used in the three above-mentioned aspects of the present invention, and the outline of pairs of hot-pressing rolls constituting the main part of the apparatus for the continuous production of a surface-consolidated lumber is shown in the perspective view of FIG. 1. In this continuous production apparatus, as shown in FIG. 1, three pairs of upper and lower hot-pressing rolls are arranged so that a lumber to be treated is continuously heat-compressed. Namely, a first pair 1 of rolls, a second pair 2 of rolls and a third pair 3 of rolls are arranged in succession from the upstream side to the down-stream side, and the pairs 1 through 3 comprise upper and lower paired rolls 1*a* and 1*b*, upper and lower paired rolls 2*a* and 2*b*, and upper and lower paird rolls 3*a* and 3*b*, respectively. An electric heater 4 is installed in each of the roll pairs 1 through 3 so that each roll is heated at a predetermined temperature, and the rotational speeds of the respective rolls are controlled by a driving motor 5 so that the treatment speed of the lumber is adjusted.

In carrying out the present invention, it is preferred that the roll distance in each of the roll pairs 1 through 3 be 80 to 95%, especially 84 to 92%, of the thickness of the lumber to be treated. If the roll distance is smaller than 80% of the thickness of the lumber to be treated, the compression ratio of the lumber exceeds 20%, and the lumber is compressed in a state where heat softening of the surface layer of the lumber to be treated is insufficient. Accordingly, in this case, the consolidation of the lumber might be transitory. If the roll distance is larger than 95% of the thickness of the lumber to be treated, the lumber is heat-softened in a state where the compression of the lumber is insufficient, and the degree of the consolidation is often insufficient.

In carrying out the present invention, it is preferred to heat one of the upper and lower rolls of at least one of the roll pairs 1 through 3 at a temperature higher than 150° C., especially a temperature higher than 180° C. If this roll temperature is lower than 150° C., heat-softening of the constituents of the lumber is not sufficient and the consolidation is temporarily effected only during the passage through the rolls. Moreover, the roll pair to be heated at a temperature higher than 150° C. is preferably one which first exerts a compressing action to the lumber, that is, the first roll pair. If the first roll pair is thus heated at a temperature higher than 150° C., the lumber to be treated is first heat-softened and the consolidating effect by the second and third roll pairs is enhanced.

Furthermore, in carrying out the present invention, it is preferred to adjust the treatment speed to 0.1 to 15.0 m/min. If the lumber to be treated is preliminarily heated, a treatment speed exceeding 15.0 m/min can be adopted.

As the lumber to be treated, there can be mentioned not only an ordinary lumber but also other wooden materials such as laminated wood, particleboard, plywood and fiberboard.

Thermosetting resins to be used in the process for the continuous production of a surface-consolidated lumber according to the present invention will now be described.

According to the process of said one aspect of the present invention, the surface of a lumber to be treated is preliminarily coated with a thermosetting resin. When the thermosetting resin-coated lumber is fed into the above-mentioned hot-pressing roll pairs 1 through 3, the thermosetting resin is polymerized to form a three-dimensional structure. Thus, the resin coating layer is cured and the surface of the lumber is effectively consolidated and hardened as well as by the above-mentioned compressing action of the roll pairs. Moreover, the abrasion resistance of the surface of the lumber coated with the thermosetting resin is further improved.

As the thermosetting resin to be used in carrying out the process of the present invention, there can be mentioned- a urea resin, a melamine resin, a phenolic resin, an epoxy resin, an unsaturated polyester resin, an alkyd resin and a urethane resin. Moreover, there can be mentioned a diallyl phthalate resin, polyethylene terephthalate, polystyrene, a tetrafluoroethylene resin, a styrene/acrylonitrile copolymer resin, a methacrylic resin, polyacrylic acid, polymethyl methacrylate, polypropylene glycol methacrylate, polyethylene glycol/-polypropylene glycol methacrylate, glycidyl methacrylate, glycerol dimethacrylate, glycerol methacrylate, diethylene glycol dimethacrylate, trimethylolpropane trimethacrylate, nylon 6 and nylon 66.

By coating the surface of a lumber with a thermosetting resin, there can be obtained a surface-consolidated lumber having a wood-plastic combined surface layer (WPC surface layer).

According to the process of said another aspect of the present invention, a thermosetting dimensional stabilizer is used instead of the above-mentioned thermosetting resin. By feeding a lumber coated with the thermosetting dimensional stabilizer into pairs of hot-pressing rolls, as in the above-mentioned case where the thermosetting resin is used, a cured resin layer is formed on the surface of the lumber, and the dimension of the surface-consolidated lumber can be stabilized by this cured resin layer. As the thermosetting dimensional stabilizer to be used in carrying out the process of the present invention, there can be mentioned, for example, a polyethylene glycol methactylate resin, a polypropylene glycol methacrylate resin, a glycerol dimethacrylate resin and a glycidyl methacrylate resin.

According to the process of said still another aspect of the present invention, a thermosetting fire-proofing agent is used instead of the thermosetting resin used in said one aspect of the present invention. By coating the surface of a lumber with this fire-proofing agent, the fire-proofness of the surface-consolidated lumber can be improved. As the fire-proofing agent to be used in carrying out the present invention, there can be mentioned, for example, a urea/phosphoric acid compound, a melamine/phosphoric acid compound, and a dicyandiamide/phosphoric acid compound.

According to said one aspect of the present invention, the thermosetting resin applied on a lumber to be treated is heated by pairs of hot-pressing rolls to harden the surface of the lumber, and the surface layer of the lumber is consolidated by the heat-compressing action, whereby a surface-consolidated lumber is continuously produced.

According to said another aspect of the present invention, a surface-consolidated lumber having a high dimensional stability imparted thereto is continuously produced, and according to said still another aspect of the present invention, a surface-consolidated lumber having a high fire-proofness imparted thereto is continuously produced.

The present invention will now be described in detail with reference to the following Examples that by no means limit the scope of the invention.

Example 1

This example illustrates one embodiment of said one aspect of the present invention. A hard maple lumber was coated with a thermosetting resin comprising diethylene glycol dimethacrylate as the main component and the coated lumber was passed through the apparatus for the continuous production of a surface-consolidated lumber, shown in FIG. 1, whereby the surface of the lumber was hardened and a surface-consolidated lumber was obtained.

For comparison, an untreated hard maple lumber was directly passed through the above-mentioned apparatus to consolidate the surface, whereby a surface-consolidated lumber was produced.

The treatment conditions adopted in this example will now be described in detail.

Treatment Conditions (1) Lumber to be treated

A hard maple lumber (having a thickness of 15 mm, a width of 120 mm and a length of 2,000 mm)

(2) Thermosetting resin

A thermosetting resin comprising 100 parts of diethylene glycol dimethacrylate (main component) and 4 parts of benzoyl peroxide (curing agent)

(3) Amount of coating with thermosetting resin 120 g/m$^2$ per run (4) Operating conditions of continuous production apparatus (a) Roll shape
100 mm in radius and 120 mm in width
(b) Roll temperature
first roll pair: 210° C.
second roll pair: 210° C.
third roll pair: 210° C.
(c) Distance between upper and lower rolls
13.5 mm
(d) Compression ratio
10%
(e) Treating speed
0.4 m/min The Barcol hardness of the surface was measured with respect to the surface-consolidated lumber obtained in the present example and the comparative lumber. The obtained results are shown in Table 1.

TABLE 1

| Treatment | Barcol Hardness | Hardness Increase Ratio |
|---|---|---|
| untreated | 43.3 | 100 |
| consolidation treatment alone | 48.1 | 111 |
| present example | 51.5 | 119 |

As is apparent from the results shown in Table 1, the Barcol hardnesses of the untreated lumber (comparative) and the lumber subjected to the consolidation treatment alone (comparative) were 43.3 and 48.1, respectively.

In contrast, the Barcol hardness of the surface-consolidated lumber of the present example, which was obtained by the thermosetting resin coating treatment and the subsequent consolidation treatment, was 51.5. Thus, it was confirmed that the surface hardness of the surface-consolidated lumber of the present example was much improved over those of the comparative lumbers.

Example 2

This example illustrates one embodiment of said another aspect of the present invention. A thermosetting dimensional stabilizer was applied on both the surfaces of a coigue lumber (occurring in Chile) and the surface-coated lumber was passed through the apparatus for the continuous production of a surface-consolidated lumber, whereby surface-consolidated lumber having a dimensional stability imparted thereto was obtained.

An untreated coigue lumber was used as the comparative lumber.

The treatment conditions adopted in the present example will now be described in detail.

Treatment Conditions (1) Lumber to be treated

A coigue lumber occurring in Chile, flat grain board, moisture content: 12±1% (having a thickness of 2.0 mm, a width of 100 mm and a length of 300 mm)

(2) Thermosetting dimensional stabilizer

A stabilizer comprising 100 parts of polyethylene glycol methacrylate (main component) and 0.8 part of potassium persulfate (curing agent)

(3) Amount (both the surfaces) of coating with thermosetting dimensional stabilizer One-coat and two-coat (120 g/m$^2$ per run)

(4) Operating conditions of continuous production apparatus

The same conditions as those adopted in Example 1 except that the distance between the upper and lower rolls was adjusted to 1.8 mm.

The surface-consolidated lumber obtained in the present example and the comparative lumber were allowed to stand still in an atmosphere maintained at a temperature of 40° C. and a relative humidity of 95% for 4 days, and the elongation of the lumber in the longitudinal direction was measured. The obtained results are shown in Table 2.

TABLE 2

| Treatment | Elongation | Anti-Swelling Capacity (ASE) |
|---|---|---|
| untreated | 7.0% | — |
| one-coat on both surfaces | 5.8% | 17% |
| two-coat on both surfaces | 4.7% | 33% |

As is apparent from the results shown in Table 2, the elongation of the untreated lumber (comparative lumber) was 7%.

In the case of the surface-consolidated lumber of the present example obtained by the thermosetting dimensional stabilizer coating treatment and the subsequent consolidation treatment, the elongation was much lower than in the comparative lumbers (both the one-coat and two-coat).

It can also been seen that when the amount of coating with the thermosetting dimensional stabilizer was increased, the anti-swelling capacity was prominently enhanced.

Example 3

This example illustrates one embodiment of said still another aspect of the present invention. A lauan plywood was coated with a thermosetting fire-proofing agent prepared under conditions described below and was passed through the apparatus for the continuous production of a surface-consolidated lumber, whereby a surface-consolidated lumber having a heat resistance imparted thereto was obtained.

An untreated lauan plywood was used as the comparative lumber.

The treatment conditions adopted in the present example will now be described in detail.

Treatment Conditions (1) Lumber to be treated

Lauan plywood (having a thickness of 3.75 mm, a width of 200 mm and a length of 300 mm)

(2) Thermosetting fire-proofing agent

Aqueous solution containing at a concentration of 50% a mixture comprising phosphoric acid, dicyandiamide and formaldehyde at a molar ratio of 1/2/1.

(3) Amount (one surface) of coating with thermosetting fire-proofing agent 150 g/m$^2$ or 270 g/m$^2$ (4) Operating conditions of continuous production apparatus The same conditions as those adopted in Example 1 except that the distance between the upper and lower rolls was adjusted to 3.40 mm.

The surface-consolidated lumber obtained in the present example was air-dried, and the dried surface-consolidated lumber and the comparative lumber were subjected to the incombustibility test of JIS A 1322. The obtained results are shown in Table 3.

TABLE 3

| Treatment | Length of Carbonization | Judgement |
|---|---|---|
| untreated | 21.4 cm | — |
| amount of coating of 150 g/m$^2$ | 9.1 cm | qualified as anti-flaming grade 2 |
| amount of coating of 270 g/m$^2$ | 7.3 cm | ditto<br>ditto |

As is apparent from the results shown in Table 3, the untreated lumber (comparative lumber) failed to satisfy the fire-proofness requirement as stipulated by JIS.

In contrast, the surface-consolidated lumber of the present example obtained by the thermosetting fire-proofing agent coating treatment and the subsequent consolidation treatment showed a much shorter length of carbonization than that of the comparative lumber and could stand the test of anti-flaming grade 2. Accordingly, it was confirmed that the surface-consolidated lumber of the present example was excellent in the fire-proofness. Moreover, it is seen that a larger amount of coating with the thermosetting fire-proofing agent gave a higher fire-proofness.

What is claimed is:

1. A process for the continuous production of a surface-consolidated lumber, which comprises coating a lumber with a thermosetting resin, said lumber having an initial thickness, feeding the coated lumber between a pair of opposed hot-pressing rolls of a plurality of pairs of opposed rolls, continuously heat-compressing the lumber between the pair of hot-pressing rolls and simultaneously curing the thermosetting resin, thereby consolidating and hardening the surface layer of the lumber, said heat-compression being carried out under conditions such that the distance between the opposed rolls of each of said pairs of rolls is 80 to 95% of the initial thickness of the lumber and with at least one of the opposed rolls of at least one of said pairs of rolls being heated to a temperature higher than 150° C.

2. A surface-consolidated lumber obtained by the continuous production process as set forth in claim 1.

3. A process for the continuous production of a surface-consolidated lumber according to claim 1, wherein said thermosetting resin is a thermosetting dimensional stabilizer thereby imparting a dimensional stability to the surface-consolidated lumber.

4. A surface-consolidated lumber obtained by the continuous production process as set forth in claim 3.

5. A process for the continuous production of a surface-consolidated lumber according to claim 1, wherein said thermosetting resin is a thermosetting fire-proofing agent, thereby imparting a fire-proofness to the surface-consolidated lumber.

6. A surface-consolidated lumber obtained by the continuous production process as set forth in claim 5.

7. The process for the continuous production of a surface-consolidated lumber according to claim 1 wherein said distance between the opposed rolls is 84 to 92% of the initial thickness of the lumber.

8. The process for the continuous production of a surface-consolidated lumber according to claim 1 wherein said plurality of pairs of opposed rolls comprises three pairs of opposed rolls and at least both opposed rolls of at least one pair are heated.

9. The process for the continuous production of a surface-consolidated lumber according to claim 1 wherein each of the opposed rolls of said three pairs of opposed rolls are heated.

10. The process for the continuous production of a surface-consolidated lumber according to claim 1 wherein the temperature of said at least one heated roll is higher than 180° C.

11. The process for the continuous production of a surface-consolidated lumber according to claim 1 wherein said thermosetting resin is selected from the group consisting of a urea resin, a melamine resin, a phenolic resin, an epoxy resin, an unsaturated polyester resin, an alkyd resin a urethane resin, polystyrene, a tetrafluoroethylene resin and a polyacrylic resin.

12. The process for the continuous production of a surface-consolidated lumber according to claim 1 wherein said lumber is coated with said resin on both sides prior to treating the coated lumber between said opposed rolls.

13. The process for the continuous production of a surface-consolidated lumber according to claim 7 wherein said plurality of opposed rolls comprises at least three pairs of opposed rolls and each roll of said three pairs of opposed rolls is heated and wherein said lumber is coated with said resin on both sides prior to treating the coated lumber between said opposed rolls.

14. The process for the continuous production of a surface-consolidated lumber according to claim 13 wherein the temperature of said heated rolls is higher than 180° C.

15. The process for the continuous production of a surface-consolidated lumber according to claim 14 wherein said thermosetting resin comprises diethylene glycol dimethacrylate with benzoyl peroxide as a curing agent.

16. The process for the continuous production of a surface-consolidated lumber according to claim 3 wherein said thermosetting resin is a thermosetting dimensional stabilizer selected from the group consisting of a polyethylene glycol methactylate resin, a polypropylene glycol methacrylate resin, a glycerol dimethacrylate resin and a glycidyl methacrylate resin.

17. The process for the continuous production of a surface-consolidated lumber according to claim 13 wherein said thermosetting resin is a thermosetting dimensional stabilizer selected from the group consisting of a polyethylene glycol methactylate resin, a polypropylene glycol methacrylate resin, a glycerol dimethacrylate resin and a glycidyl methacrylate resin.

18. The process for the continuous production of a surface-consolidated lumber according to claim 14 wherein said thermosetting resin is a thermosetting dimensional stabilizer selected from the group consisting of a polyethylene glycol methactylate resin, a polypropylene glycol methacrylate resin, a glycerol dimethacrylate resin and a glycidyl methacrylate resin.

19. The process for the continuous production of a surface-consolidated lumber according to claim 18 wherein said thermosetting dimensional stabilizer resin comprises polyethylene glycol methacrylate with potassium persulfate as a curing agent.

20. The process for the continuous production of a surface-consolidated lumber according to claim 5 wherein said thermosetting resin is a thermosetting fire-proofing agent selected from the group consisting of a urea/phosphoric acid compound, a melamine/phophoric acid compound, and a dicyandiamide/phosphoric acid compound.

21. The process for the continuous production of a surface-consolidated lumber according to claim 13 wherein said thermosetting resin is a thermosetting fire-proofing agent selected from the group consisting of a urea/phosphoric acid compound, a melamine/phophoric acid compound, and a dicyandiamide/phosphoric acid compound.

22. The process for the continuous production of a surface-consolidated lumber according to claim 14 wherein said thermosetting resin is a thermosetting fire-proofing agent selected from the group consisting of a urea/phosphoric acid compound, a melamine/phophoric acid compound, and a dicyandiamide/phosphoric acid compound.

23. The process for the continuous production of a surface-consolidated lumber according to claim 14 wherein said thermosetting fire-proofing agent is a mixture comprising phosphoric acid, dicyandiamide and formaldehyde at a molar ratio of 1/2/1.

* * * * *